US006600288B2

(12) United States Patent
Durth et al.

(10) Patent No.: US 6,600,288 B2
(45) Date of Patent: Jul. 29, 2003

(54) COOKING DEVICE WITH VOLTAGE, PHASE AND FREQUENCY CONVERTER

(75) Inventors: Wilfried Durth, Landsberg (DE); Erwin Schuller, Wolfratshausen (DE)

(73) Assignee: Rational Aktiengesellschaft, Landsberg/Lech (DE)

( * ) Notice: Subject to any disclaimer, the term of this patent is extended or adjusted under 35 U.S.C. 154(b) by 0 days.

(21) Appl. No.: 09/899,428

(22) Filed: Jul. 5, 2001

(65) Prior Publication Data

US 2002/0014875 A1 Feb. 7, 2002

(30) Foreign Application Priority Data

Jul. 5, 2000 (DE) ..... 100 32 762

(51) Int. Cl.[7] ..... G05B 11/01

(52) U.S. Cl. ..... 318/629; 318/798; 318/800; 318/801; 318/803; 219/756; 219/757; 99/DIG. 14; 363/34; 363/37

(58) Field of Search ..... 318/700, 708, 318/798, 799, 800, 801, 803, 809, 629, 632; 219/600, 608, 678, 756, 757; 99/DIG. 14; 363/34, 37

(56) References Cited

U.S. PATENT DOCUMENTS 4,296,367 A * 10/1981 Hirata ..... 318/808
4,390,766 A * 6/1983 Horinouchi ..... 219/10.55 B
4,504,751 A * 3/1985 Meier ..... 310/62
4,532,465 A * 7/1985 Renard ..... 318/814
4,656,571 A * 4/1987 Umezu ..... 363/37
4,736,595 A 4/1988 Kato ..... 62/160
4,856,078 A * 8/1989 Konopka ..... 388/831
5,091,617 A * 2/1992 Maehara et al. ..... 219/10.55 B
5,594,312 A * 1/1997 Schwendemann et al. .. 318/799
6,147,336 A * 11/2000 Ushijima et al. ..... 219/601
6,208,113 B1 3/2001 Lelkes et al. ..... 318/807
6,198,240 B1 * 3/2002 Notohara et al. ..... 318/268

FOREIGN PATENT DOCUMENTS

| | | |
|---|---|---|
| DE | 34 11 723 | 11/1985 |
| DE | 37 02 658 | 8/1987 |
| DE | 42 22 092 | 1/1994 |
| DE | 197 05 672 | 4/1998 |
| DE | 198 43 106 | 3/2000 |
| EP | 0 585 703 | 3/1994 |
| EP | 0 579 074 | 4/1996 |

* cited by examiner

*Primary Examiner*—Bentsu Ro
*Assistant Examiner*—Rina I. Duda
(74) *Attorney, Agent, or Firm*—Schiff Hardin & Waite

(57) ABSTRACT

A cooking device having a cooking chamber, a motor unit for driving a fan for purposes of circulating cooking chamber atmospheres in the cooking chamber, a control and regulator unit cooperating with the motor unit and a voltage phase and frequency converter which has power supply connections for the input of a.c. voltage signals L1 and at least one connection to the control and regulator unit and an output connection for transmitting three-phase voltage signals U, V and W with adjustable amplitude, frequency and phase to the motor unit.

3 Claims, 1 Drawing Sheet

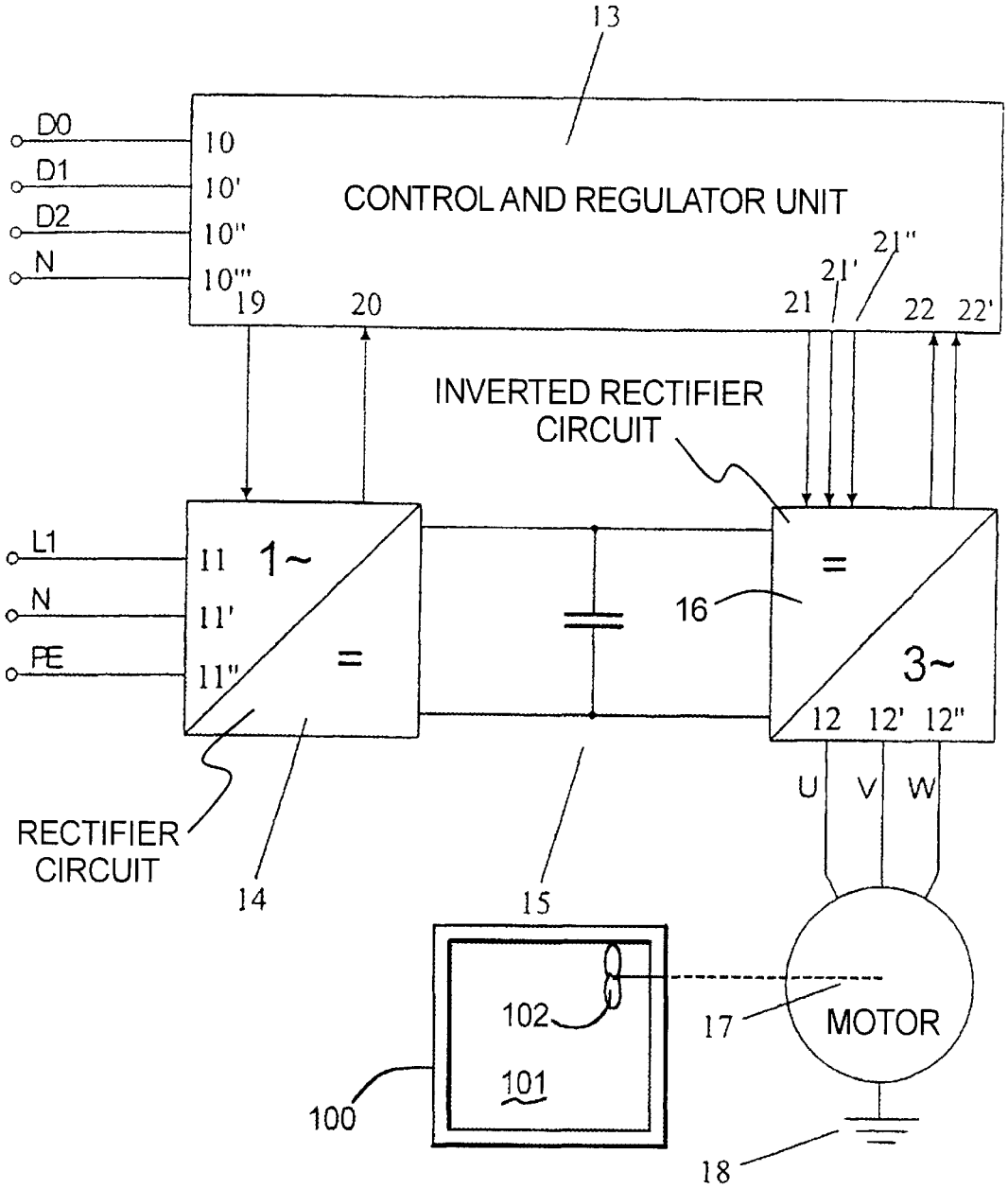
13
D0
D1
D2
N
10
10'
10"
10'''
CONTROL AND REGULATOR UNIT
19
20
21
21'
21"
22
22'
INVERTED RECTIFIER CIRCUIT
L1
N
PE
11
11'
11"
1~
=
16
=
3~
12
12'
12"
U
V
W
RECTIFIER CIRCUIT
14
15
102
101
100
17
MOTOR
18

COOKING DEVICE WITH VOLTAGE, PHASE AND FREQUENCY CONVERTER

BACKGROUND OF THE INVENTION

The present invention is directed to a cooking device having a cooking chamber, a motor unit for driving a fan for purposes of circulating cooking chamber atmosphere in the cooking chamber and a control unit and/or regulating unit cooperating with the motor unit.

In traditional cooking devices, it is differentiated between the embodiments for different mains supplies or power supplies. In other words, each cooking device must be adapted to the power supply connection that is present at the respective location, so that not only differently constructed devices are necessary for different countries, but a correct operating mode cannot be guaranteed at the same time given fluctuations of the power from different types of power supplies.

For example, European Patent 0 585 703 A2 discloses an electromotor controlled by a frequency converter. The use of a frequency converter is described, which exhibits a rectifier circuit, an intermediate circuit, an a.c. circuit and a control and regulator circuit and which functions independently of whether a single-phase mains or a three-phase mains is available as the power supply, since only the rectifier circuit must be correspondingly adapted or, respectively, designed.

SUMMARY OF THE INVENTION

An object of the present invention is to further develop a cooking device so that the disadvantage of the prior art is overcome, so that a universal utilization is possible independent of the respective power supply connections.

This object is inventively achieved by a voltage, phase and/or frequency converter having the power supply connection for input of a.c. voltage signals L1, at least one connection to a control and regulator unit and an output connection for transmitting three-phase a.c. voltage signals U, V, W with an adjustable amplitude, frequency and/or phase to the motor unit.

It can be provided that the voltage, phase and/or frequency converter comprises a rectifier circuit, an intermediate circuit and an inverted rectifier circuit, whereby the input a.c. voltage signals L1 can be rectified by the power supply connection in the rectifier circuit, the rectified voltage can be smoothed by the rectifier circuit in the intermediate circuit and the smoothed voltage can be converted into the three-phase a.c. voltage signals U, V, W by the intermediate circuit in the inverted rectifier circuit.

An embodiment of the invention is characterized in that the control and/or regulator unit is connected to a rectifier circuit via at least one voltage and/or current connection and/or via a correction connection for reducing a phase shift between voltage and current and/or is connected to the inverted rectifier circuit via at least one three-phase control connection for adjusting the three phases of the three-phase a.c. voltage signals U, V, W, with preferably minimized harmonic waves.

Embodiments of the invention are preferred which are characterized by an interference sensory mechanism, particularly for monitoring a short-circuit and/or temperature, in cooperation with the inverted rectifier circuit and the control and regulator unit via at least one interference sensory connection.

In addition, it can be inventively provided that the intermediate circuit has a capacitor.

It can also be inventively provided that the inverted rectifier circuit has a pulse inverter.

In addition, it is inventively proposed that the voltage, phase and/or frequency converter is adjusted via the control and regulator unit instantaneously, or at least with a selective time-delay.

It is also inventively proposed that the rotational speed, the acceleration ramp and/or the brake ramp of the fan can be adjusted and/or modulated via the control and regulator unit and the motor unit preferably is infinitely variable.

Moreover, it can be inventively proposed that the motor unit has a three-phase asynchronous motor or a three-phase synchronous motor.

Finally, it is inventively proposed that the motor unit has a motor brake that can be adjusted and/or modulated via the control and regulator unit.

Given a traditional cooking device, the invention, therefore, is based on the surprising knowledge of using a voltage converter that cooperates with a control and regulator unit for driving a motor unit for a fan for circulating cooking chamber atmosphere in a cooking space, namely power electronics composed of modem power converter technology and digital signal processing, in order to generate a current and voltage system of the worldwide present electrical power supplies that are optimized for cooking devices. The mechanical and dynamic requirements are to be inventively optimally transferred to the motor unit via the control and regulator unit. Furthermore, the following advantages can be inventively achieved.

Regardless of the respective power supplies, namely the input voltage of a cooking device, one single type of cooking device can be used. The frequency, the phase and/or the amplitude of the power supplies, which can be applied to the motor unit, can be adjusted independently of the frequency and the amplitude of the chronologically constant but internationally variable power supply. Voltage fluctuations, for example, of +10% and/or −15% of a single-phase power supply can also be compensated.

The volume performance of the cooking device can be increased. The efficiency of the cooking device can also be increased by reducing harmonic waves.

The rotary frequency of the fan can be continuously adjusted from 1 to 100 Hertz, for example. The rotary frequency of the fan can be modulated via the control and regulator unit for increasing the efficiency of the heat transmission and for the homogenization of the same.

The run-up phase of a fan can be shortened in that the ascending gradient of the acceleration ramp is increased, so that a better heat transmission with respect to a cooking product in the cooking chamber is possible.

Within an extremely short period of time, cooking phases can be stopped in a programmed fashion via the use of a motor brake, so that the discharge of steam from the cooking device is reduced, as well as the idle time given a change of direction.

Additional advantages and features of the invention will be readily apparent from the following description of the preferred embodiment, the drawing and claims.

BRIEF DESCRIPTION OF THE DRAWING

The FIGURE is a block diagram of a motor control for the inventive cooking device.

DESCRIPTION OF THE PREFERRED EMBODIMENT

The principles of the present invention are useful when incorporated into a cooking device 100 which has a cooking chamber 101 with a fan 102 with a motor 17.

The inventive cooking device 100 has a motor control which, on one hand, receives control signals D0, D1, D2 on an input side of the control and regulator unit 13 and, on the other hand, receives a.c. voltage signals from the power supply or main, for example a single-phase a.c. voltage signal L1 of the power supply, in addition to a zero signal N, which has a ground connection PE. In addition, the motor control outputs three-phase a.c. voltage signals U, V and W on an output side. For this purpose the motor control has input connections 10, 10', 10" and 10'", power supply connections 11, 11' and 11" and output connections 12, 12' and 12". The signal input connections 10, 10', 10" and 10'" are a component of a control and regulator unit 13, whereas the power supply connections 11, 11' and 11 " and the output connections 12, 12' and 12" are a component of a voltage converter, which has a rectifier circuit 14 with the power supply connections 11, 11' and 11", an intermediate circuit 15 and an inverted rectifier circuit 16 with the output connections 12, 12' and 12" for the three-phase a.c. voltage signals U, V and W. These signals can be applied to the asynchronous motor 17 of the cooking device, which is also connected to the ground 18. The single-phase a.c. voltage signals L1 of the power supply are rectified in the rectifier unit 14, are then smoothed in the intermediate circuit 15 and converted in the inverted rectifier circuit 16 into the three-phase a.c. voltage signals U, V and W in order to be outputted to the asynchronous motor 17, dependent on the control signals D0, D1 and D2.

The control and regulator unit 13 interacts with the rectifier circuit 14 via a correction connection 19 and a voltage and current connection 20. Voltage and current acquired in the rectifier circuit 14 reach the control and regulator unit 13 via the connections 20. The control and regulator unit 13, dependent on this voltage and current, regulates the rectifier circuit 14 via the correction connection 19, so that a phase shifting between the voltage and the current of the power supply connection side of the voltage converter does not occur.

The inverted rectifier circuit 16 and the control and regulator unit 13 interact with one another via three-phase control connections 21, 21' and 21 " and interference sensory connections 22 and 22'. The control and regulator unit 13 can adjust the three phases of the three-phase a.c. voltage signals U, V and W, particularly by adjusting the frequency and the amplitude of the three-phase a.c. voltage signals U, V and W, with or without time delay, and potentially occurring disturbances, which are particularly detected by a short-circuit monitoring and/or temperature monitoring, can be counteracted.

Overall, the control and regulator unit 14 also assures that current is drawn from the single-phase power supply a.c. voltage signals L1 by simultaneously minimizing harmonic waves in the voltage converter.

The rectifier circuit 14 can be adapted to the actual power supply a.c. voltage via the control and regulator unit 13 for compensating voltage fluctuations in the power supply connections, for example.

For the first time, cooking devices can be universally utilized as a result of the inventive motor control, which gives increased capacity and, at the same time, increased efficiency, better environmental compatibility and improved cooking product quality.

Although various minor modifications may be suggested by those versed in the art, it should be understood that we wish to embody within the scope of the patent granted hereon all such modifications as reasonably and properly come within the scope of our contribution to the art.

We claim:

1. A cooking device having a cooking chamber, a motor unit for driving a fan for purposes of circulating cooking chamber atmospheres in the cooking chamber and a control and/or regulator unit cooperating with the motor unit, the improvement comprising a voltage, phase and/or frequency converter comprising power supply connection for input a.c. voltage signals L1, at least one connection to the control and/or regulator unit and an output connection for transmitting three-phase voltage signals U, V, W with adjustable amplitude, frequency and/or phase to the motor unit, the voltage, phase and frequency converter having a rectifier unit, an intermediate circuit and an inverted rectifier circuit, the input a.c. voltage signals L1 being rectified by the power supply connections in the rectifier circuit, the rectified voltage can be smoothed by the rectifier circuit in the intermediate circuit and the smoothed voltage being converted by the intermediate circuit in the inverted rectifier circuit into three-phase a.c. voltage signals U, V, W, the control and/or regulator unit being connected to the rectifier unit by at least one voltage and current connection, and by a correction connection for reducing the phase shift between the voltage and current and the control and/or regulator unit being connected to the inverted rectifier circuit by at least one three-phase control connection for adjusting the three phases of the a.c. voltage signals U, V, W with minimized harmonic waves.

2. A cooking device according to claim 1, wherein an interference sensory mechanism, which monitors a short-circuit and/or temperature, cooperates with the inverted rectifier unit and the control and/or regulator unit by at least one interference sensory connection.

3. A cooking device having a cooking chamber, a motor unit for driving a fan for purposes of circulating cooking chamber atmospheres in the cooking chamber and a control and/or regulator unit cooperating with the motor unit, the improvement comprising a voltage, phase and/or frequency converter comprising power supply connection for input a.c. voltage signals L1, at least one connection to the control and/or regulator unit and an output connection for transmitting three-phase voltage signals U, V, W with adjustable amplitude, frequency and/or phase to the motor unit, the voltage, phase and frequency converter having a rectifier unit, an intermediate circuit and an inverted rectifier circuit, the input a.c. voltage signals L1 being rectified by the power supply connections in the rectifier circuit, the recitified voltage can be converted by the intermediate circuit in the inverted rectifier circuit into three-phase a.c. voltage signals U, V, W, and an interference sensory mechanism, which monitors a short-circuit and/or temperature, cooperating with the inverted rectifier circuit and the control and/or regulator unit via a least on interference sensory connection.

* * * * *